US005577281A

United States Patent [19]

Mital et al.

[11] Patent Number: 5,577,281

[45] Date of Patent: Nov. 26, 1996

[54] STRETCHER

[75] Inventors: Marc-Henri Mital, Saint Maurice; Yves Vidal, Chanteau, both of France

[73] Assignee: E.I.F., Montreuil, France

[21] Appl. No.: 454,163

[22] PCT Filed: Dec. 10, 1993

[86] PCT No.: PCT/FR93/01231

§ 371 Date: Jun. 7, 1995

§ 102(e) Date: Jun. 7, 1995

[87] PCT Pub. No.: WO94/13240

PCT Pub. Date: Jun. 23, 1994

[30] Foreign Application Priority Data

Dec. 11, 1992 [FR] France ..... 92 14963

[51] Int. Cl.[6] ..... A61G 1/00; A61G 1/013; A61G 1/048

[52] U.S. Cl. ..... 5/625; 5/627; 5/922; 5/81.1 T

[58] Field of Search ..... 5/625, 627, 628, 5/81.1, 922, 81.1 T

[56] References Cited

U.S. PATENT DOCUMENTS 2,614,266 10/1952 Smith ..... 5/625

4,993,092 2/1991 Weeks ..... 5/484

FOREIGN PATENT DOCUMENTS 402521 10/1909 France .

8816352 6/1989 Germany .

939041 10/1963 United Kingdom ..... 5/627

1472272 5/1977 United Kingdom ..... 5/625

*Primary Examiner*—Alexander Grosz

*Attorney, Agent, or Firm*—Young & Thompson

[57] ABSTRACT

A stretcher comprises an upper sheet and a lower sheet selectively joined together to form a plurality of transverse sleeves. In combination, a plurality of slats having a length greater than the transverse dimension of the sleeves are removably retainable within the transverse sleeves. The slats are provided at their end portions located outside said sleeves with handles to permit transporting of the stretcher. Alternatively, the stretcher comprises a sheet having on one of its surfaces strips (16) of hook and loop type elements, in combination with a plurality of slats that are longer than the width of the sheet. The slats have hook and loop type fasteners adapted to cooperate to removably attach the slats to the hook and loop type fastener strips on the sheet. The said slats have handles at their end portions, spaced from the edges of the sheet, to permit transporting of the stretcher.

16 Claims, 4 Drawing Sheets

STRETCHER

The present invention relates to equipment for transferring the sick or the injured lying down and relates more particularly to stretchers.

Stretchers of known type, used especially for emergency action in the field or in an urban environment, which consist in picking up a sick or injured individual, then in transferring him from the place of the accident to the care unit, generally consist of flexible or rigid shafts, sometimes articulated as two half-shells.

The use of these various stretchers for picking up the injured or sick individual with a view to transporting him, leads to the patient being lifted then placed on the stretcher and therefore leads to him being subjected to manipulation which sometimes risks aggravating an injury or alternatively leading to reactions of pain. Furthermore, these operations often involve a large amount of effort on the part of the care personnel or emergency services.

The present invention aims to rectify the drawbacks of the known stretchers by creating a stretcher which, while being of a very simple and inexpensive construction, makes it possible to provide transfer or transport of a sick or injured individual with the least possible amount of effort, and practically without manipulating him.

Its subject is therefore a stretcher for transferring and/or transporting patients, the sick or the injured, consisting of a sheet, characterized in that the sheet includes means distributed along its length for removably holding slats, the latter being provided at their ends with means for holding.

According to a specific characteristic of the invention, the means for removably holding the slats include transverse sleeves, the slats being inserted removably and so that they can be combined in the said sleeves.

According to another specific characteristic of the invention, the sheet of the stretcher is formed of a first layer of impervious and strong plastic intended to be in contact with the ground and of a second layer of nonwoven fabric having absorbent and comfortable properties, intended to be in contact with the patient, even an unclothed patient, the first and second layers being joined together by bonding or welding. The sleeves for the slats are made by fixing lengths of sheet of corresponding width to the sheet at the appropriate points.

According to another characteristic of the invention, the means for removably holding the slats consist of hook and loop type fasteners fixed to at least one face of the sheet and interacting with complementary hook and loop type fasteners fixed to the slats.

According to another characteristic of the invention, a layer of foam for improving the level of comfort is interposed between the first and second layers forming the sheet of the stretcher.

According to yet another characteristic of the invention, the slats are made of plastic or of metal.

According to an additional characteristic of the invention, the means for holding consist of rounded hand slots provided at the two ends of each slot.

According to yet another characteristic, the means for holding consist of handles made of a strip of sheet fixed to the two ends of each slat and designed so that if necessary they can receive poles.

The invention will be better understood with the aid of the description which will follow, given solely by way of example and made with reference to the appended drawings in which.

Figures 1, 2:
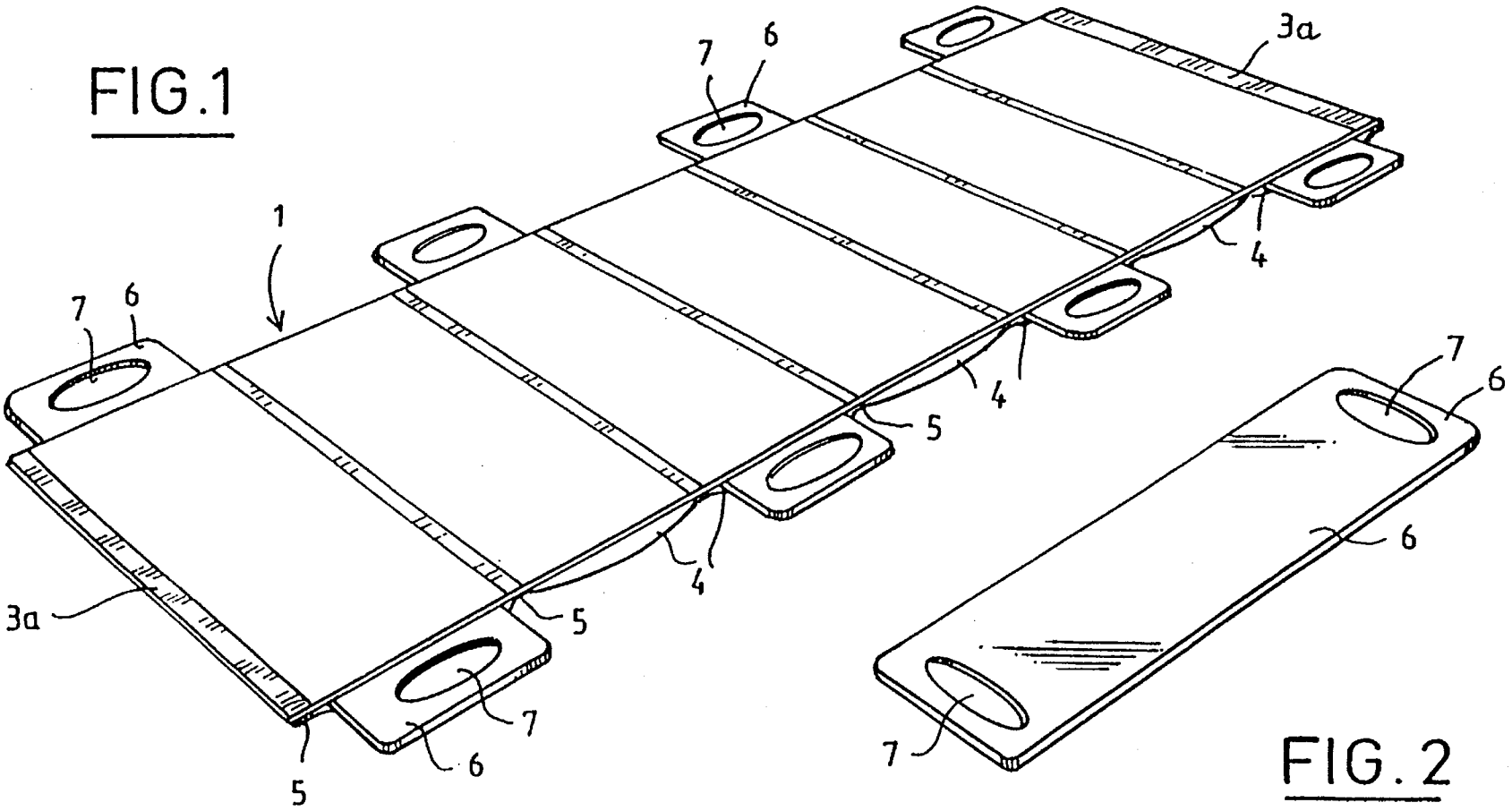
FIG. 1 is a perspective view of a stretcher according to the invention.
FIG. 2 is a perspective view of a slat forming part of the construction of the stretcher of FIG. 1.

The stretcher represented in FIG. 1 includes a sheet 1 formed of two superimposed layers 2 and 3.

The first layer 2 is made of an impervious and robust plastic and forms the lower support layer.

The plastic used is advantageously polyethylene.

To the first layer 2 is fixed, for example by bonding or welding, a second layer 3 of a nonwoven fabric having absorbent and-comfortable properties, intended to be in contact with the patient and which can be tolerated pleasantly even by an unclothed patient.

When the layers 2 and 3 are joined by welding, at the ends of the sheet, the layers 2 and 3 are attached using very strong welds 3*a*.

Figures 1A, 2A:
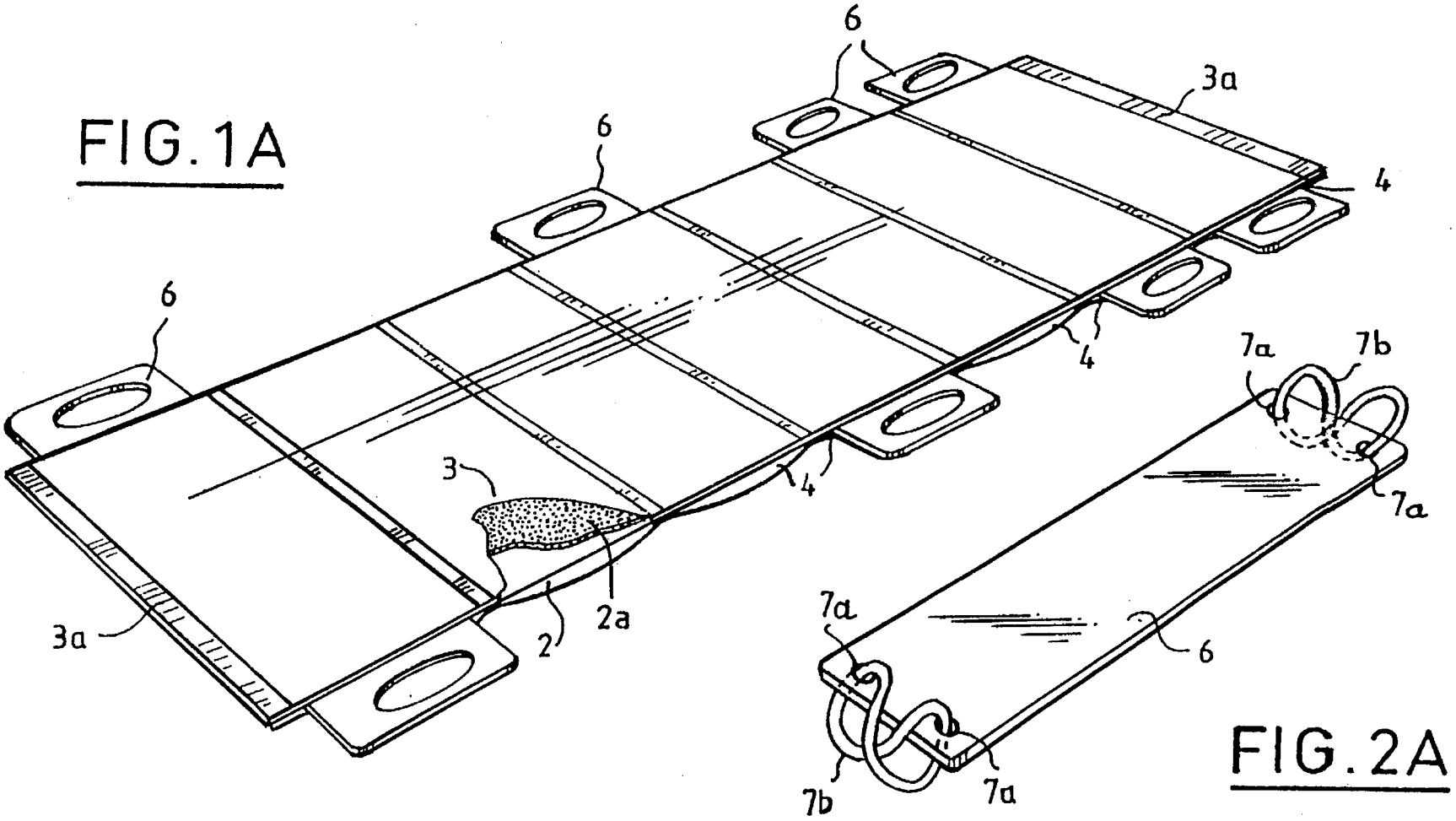
FIG. 1A is a perspective view of the stretcher of FIG. 1 with another arrangement of the slats.
FIG. 2A is a perspective view of an alternative to the slat of FIG. 2.

According to an alternative, a layer of foam 2*a* shown in FIG. 1A is slipped in between the layers 2 and 3 in order to improve the level of comfort of the stretcher.

Sleeves 4 located at defined intervals are formed in the sheet thus constructed, from one end of the sheet to the other, and these can be used in a combined fashion to best suit the morphology of the patient.

The sleeves 4 are made, for example, by bonding transverse lengths 5 of appropriate width onto the impervious layer 2 via their longitudinal edges, the transverse edges of these lengths defining, with the sheet 1, the openings of the respective sleeves. The lengths of sheet 5 are fixed along the width of the sheet.

The transverse layers 5 are advantageously made of the same substance as the impervious layer 2.

A flexible slat 6 made of plastic, for example made of polyvinyl chloride, is fitted into each of the appropriate sleeves.

An elongate slot 7 forming a handle is provided at the two ends of each slat.

According to an alternative, the member for holding may consist of a handle made of a strip of sheet fixed to each end of the slat, and which may allow the use of poles.

This alternative is represented in FIG. 2A which shows a slat, at the ends of which are pierced holes 7*a* in which strips 7*b* forming members for holding are engaged.

In the embodiment described with reference to FIG. 1, the stretcher includes seven sleeves 4 for receiving the slats, one sleeve being provided at each end of the sheet 1 at head and foot height and five other sleeves being formed in intermediate regions between the abovementioned ends, at the shoulders, the spinal column, the pelvis and the lower limbs. In the most common use, four slats carefully placed are sufficient to transfer and/or transport the patient.

The four slats of-the stretcher of FIG. 1 are housed in sleeves 4 separated from one another by sleeves left unoccupied. There is therefore one slat 6 to support the patient at his head, at the spinal column, at the pelvis and at the feet.

However, if it is desired to support different parts of the body, the arrangement of the slats may be modified.

Thus, FIG. 1A shows another arrangement of the slats 6 in the sleeves 4 of the sheet which is intended to reinforce the lumbar support of the patient.

For this purpose, two slats 6 are placed side by side to support the head and the shoulders, one slat is placed at the pelvis and one slat is placed at the feet.

The fact of using four slats allows four individuals, each taking hold of the ends of one side of two adjoining slats, to transport the stretcher with a maximum level of comfort and safety and a minimum of effort.

FIGS. 3 to 7 diagrammatically represent the operations of transferring a patient with the aid of the stretcher according to the invention.

Figure 3:
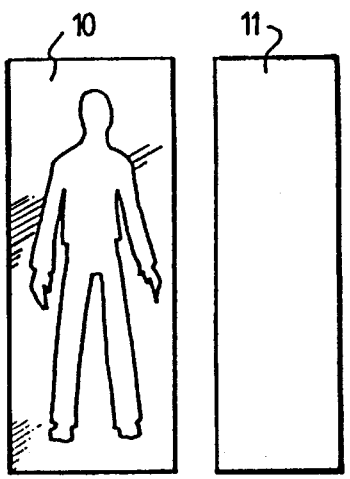

FIG. 3 shows diagrammatically a patient stretched out on a bed 10 and who is to be transferred with a minimum of manipulation onto a trolley 11 placed beside the bed.

Figure 4:
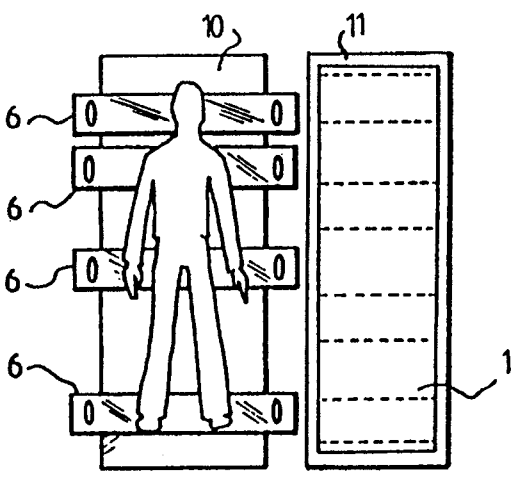

In order to transfer the sick individual from the bed 10 onto the trolley 11, the flexible slats 6 are first of all inserted between the body of the patient and the surface of the bed, without lifting the patient, at appropriate points of the body to allow the body to slide by pulling on the slats. Having thus inserted the slats under the body of the patient, he is slid effortlessly onto the sheet 1 of the stretcher spread out on the trolley 11 without it having been necessary to manipulate the patient in any way in order to move him. This transfer takes place regardless of the stretched out position of the patient. This operation is represented in FIG. 4.

Figure 5:
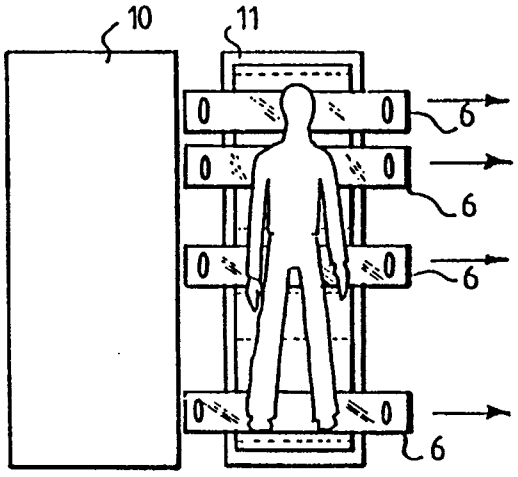
FIGS. 3 to 7 are diagrammatic views representing the operations of transferring a patient with the aid of the stretcher according to the invention. The transfer applies to all the most common situations.

FIG. 5 shows the patient stretched out on the canvas 1 of the stretcher supported by the trolley 11.

Figure 6:
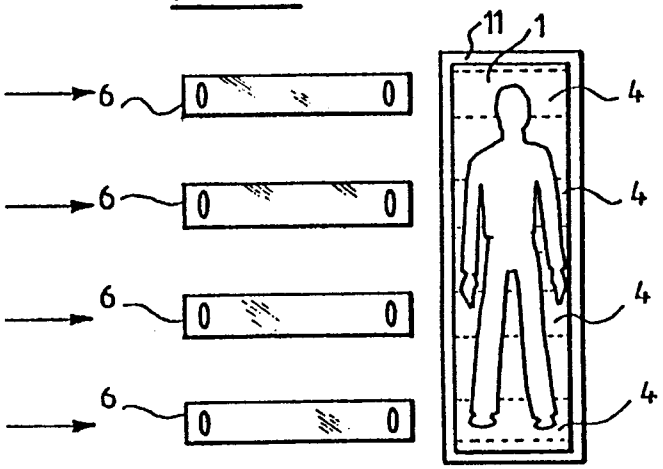

The flexible slats 6 are then withdrawn as represented by the arrows in FIG. 5 and are reinserted into the appropriate sleeves 4 of the sheet 1 as represented in FIG. 6.

Figure 7:
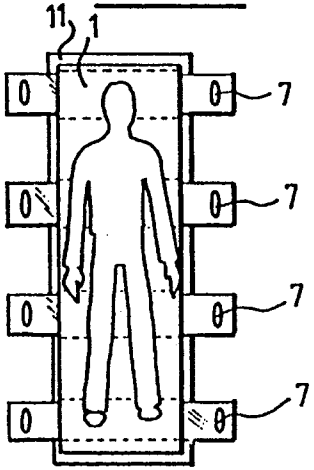

At the end of this operation represented in FIG. 7, the patient is lying down on the stretcher with the slats 6 inserted into the appropriate sleeves 4 of the latter and the stretcher is ready to be taken away to its future destination by four individuals who can each grab hold of two ends of the adjoining slats 6 by inserting their hands into the end slots 7 in the these slats, or by introducing two poles through the strips of sheet which have been put in place beforehand (FIG. 2A).

Figure 8:
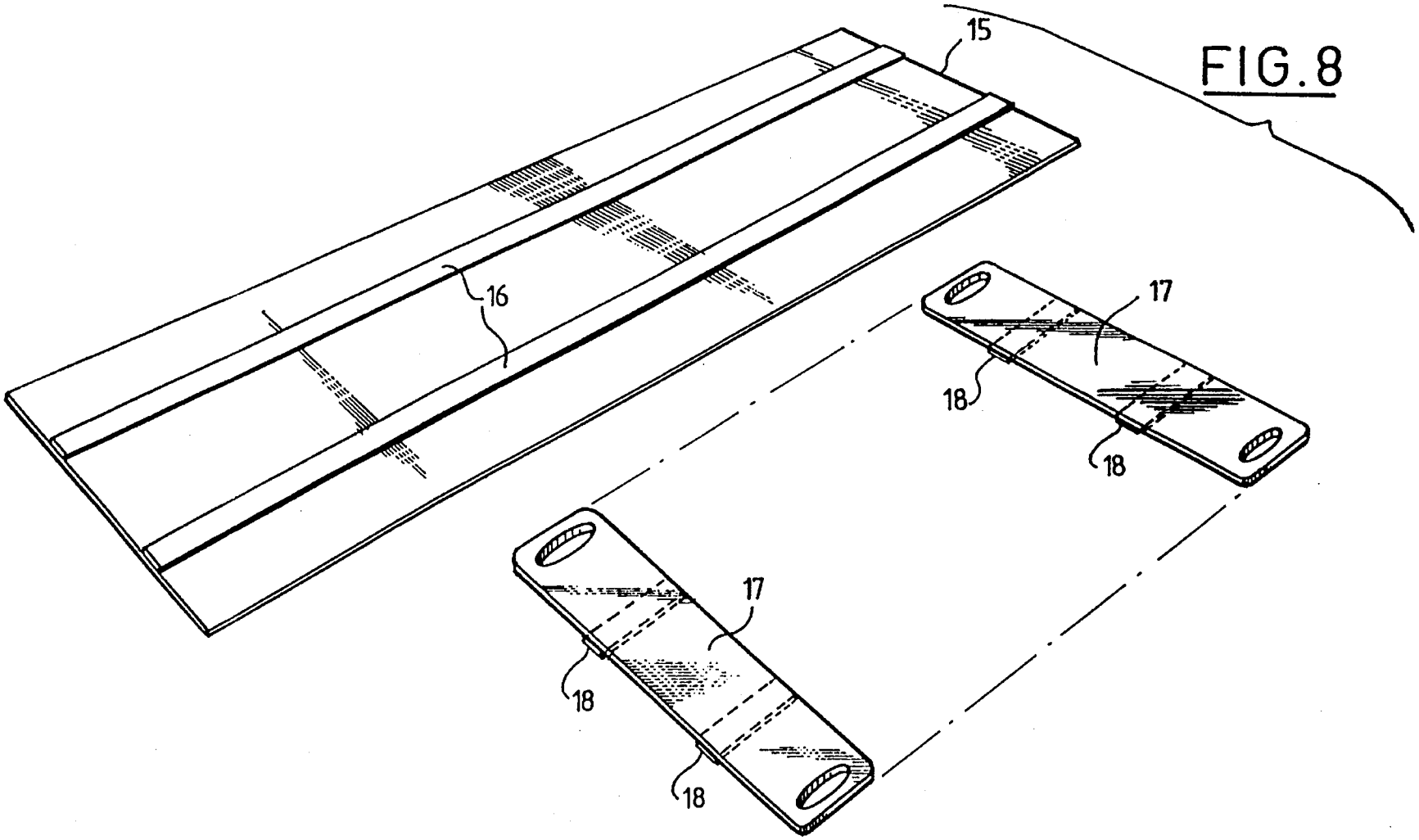
FIG. 8 is an exploded perspective view of an alternative of the stretcher according to the invention.

The stretcher represented in FIG. 8 differs from the one previously described in that it includes a sheet 15 provided over its entire length with a hook and loop type fastener in the form of tapes 16 for removably holding slats 17 provided for this purpose with touch-and-close elements 18 which complement the elements 16.

In FIG. 8, the sheet has been represented so that its face bearing the tapes 16 of hook and loop type fasteners points upwards.

It is, however, understood that the sheet is normally used with its tapes of hook and loop type fasteners pointing downwards.

With such a layout, in order to transfer a patient lying down on the sheet 15, it is sufficient to slip slats 17 equipped with their tapes of hook and loop type fasteners under the sheet at appropriate points until these tapes come into engagement with the tapes 16 of the sheet 15 and thus fix the slats 17 to the sheet 15 sufficiently to allow the patient to be moved in order to transfer him, for example, from a bed onto a trolley or the like.

In the example which has just been described, the sheet bears two tapes 16 of hook and loop type fasteners on one of its faces.

It may equally well bear just one tape which then interacts with complementary elements of hook and loop type fasteners situated on just one side of the slats.

The hook and loop type fastener elements of the sheet and of the slats may equally well be produced in the form of discontinuous regions.

The sheet may possibly include hook and loop type fastener elements on both faces.

Returning to the embodiment described with reference to FIGS. 1 to 4, the sleeves 4 may each be internally equipped with at least one hook and loop type fastener element (not represented) interacting with a hook and loop type fastener complementary element (not represented) borne by the corresponding slat.

The principle of use described hereinabove applies, without restriction, to other known situations such as, for example, picking up a casualty from the field and transferring him to a rigid stretcher or to a depression, bean bag mattress to be taken away, or yet again receiving a casualty from an ambulance going towards the operation unit, or transferring a casualty who has been operated on from the operation unit to a bed or some other means of being taken away.

In the embodiment which has just been described, the sheet of the stretcher is made from a particularly cheap substance and can therefore be disposed of after use.

It is equally possible to envisage producing stretcher sheets according to the invention from washable substances which can be sterilized in an oven, which allows it to be used as a sterile pack.

The stretcher according to the invention offers the advantage of having a very small overall size insofar as it can be rolled up and thus occupy only a width corresponding to the width of the slats which it includes. The sheet of the stretcher can possibly just be folded into an even smaller size.

The slats of the stretcher are in themselves means for lifting and transporting a sick or injured individual over a short distance, this being with a minimum of manipulation.

For this purpose, their width is designed according to the extent of the regions of the body which they generally have to support, such as the head, the shoulders, the pelvis and the feet.

As a consequence, at the moment when a patient is lifted, with the aid of the slats alone, these slats have an additional function of supporting those parts of the body beneath which they have been slipped.

We claim:

1. A stretcher comprising an upper sheet and a lower sheet selectively joined together to form a plurality of transverse sleeves, in combination with a plurality of slats having a length greater than the transverse dimension of the sleeves, and removably retainable within said transverse sleeves, said slats provided at their end portions located outside said sleeves with means for holding thereby to permit transporting of the stretcher.

2. Stretcher according to claim 1, wherein said upper sheet is a layer of impervious plastic, and wherein said lower sheet is a layer of nonwoven fabric having absorbent properties, said upper and lower sheets being joined together by bonding or welding.

3. Stretcher according to claim 2, wherein said upper sheet is made of polyethylene.

4. Stretcher according to claim 1, further comprising a layer of foam interposed between said upper and lower sheets, for improving a comfort level of said stretcher.

5. Stretcher according to claim 1, wherein said upper and lower sheets are made of the same material.

6. Stretcher according to claim 1, wherein said slats are made of plastic or metal.

7. Stretcher according to claim 6, wherein said slats are made of polyvinylchloride.

8. Stretcher according to claim 1, wherein said holding means comprise rounded hand slots.

9. Stretcher according to claim 1, wherein said holding means comprise strips of canvas fixed at said end portions of said slats.

10. Stretcher according to claim 1, wherein said slats are flexible.

11. A stretcher comprising a sheet having on one of its surfaces strips (16) of hook and loop type fastening elements, in combination with a plurality of slats that are longer than the width of the sheet, said slats having hook and loop type fastener means adapted to cooperate to removably attach the slats to the hook and loop type fastener strips on the sheet, said slats having means for holding at their end portions, spaced from the edges of the sheet, to permit transporting of the stretcher.

12. Stretcher according to claim 11, wherein said slats are made of plastic or metal.

13. Stretcher according to claim 12, wherein said slats are made of polyvinylchloride.

14. Stretcher according to claim 11, wherein said holding means comprise rounded hand slots.

15. Stretcher according to claim 11, wherein said holding means comprise strips of canvas fixed at said end portions of said slats.

16. Stretcher according to claim 11, wherein said slats are flexible.

* * * * *